US011510508B2

(12) United States Patent
Wood

(10) Patent No.: US 11,510,508 B2
(45) Date of Patent: Nov. 29, 2022

(54) INTEGRATED DISPLAY COORDINATION SYSTEMS

(71) Applicant: Carina Wood, West Palm Beach, FL (US)

(72) Inventor: Carina Wood, West Palm Beach, FL (US)

( * ) Notice: Subject to any disclaimer, the term of this patent is extended or adjusted under 35 U.S.C. 154(b) by 0 days.

(21) Appl. No.: 17/398,334

(22) Filed: Aug. 10, 2021

(65) Prior Publication Data

US 2021/0369013 A1 Dec. 2, 2021

Related U.S. Application Data

(62) Division of application No. 16/679,156, filed on Nov. 9, 2019, now Pat. No. 11,147,398.

(60) Provisional application No. 62/760,172, filed on Nov. 13, 2018.

(51) Int. Cl.
*A47F 7/00* (2006.01)
*A47F 3/00* (2006.01)

(52) U.S. Cl.
CPC ..... *A47F 7/0071* (2013.01); *A47F 3/001* (2013.01); *A47B 2220/008* (2013.01)

(58) Field of Classification Search
CPC ..... A47F 3/001; A47F 7/0071; A47F 5/0823; A47F 5/083; A47F 5/0815; A47F 5/0807; A47B 2220/008
See application file for complete search history.

(56) References Cited

U.S. PATENT DOCUMENTS

D22,569 S * 6/1893 Yearous ..... D6/680
2,102,982 A * 12/1937 Taylor ..... A47F 5/025 40/473
4,040,520 A * 8/1977 Joaquin ..... A47F 5/02 211/163
D274,056 S * 5/1984 Myer ..... D26/52
5,477,969 A * 12/1995 Beeskau ..... A47F 5/0815 248/225.11
5,653,348 A * 8/1997 MacDonald ..... A47F 5/0807 211/88.01
5,709,441 A * 1/1998 Bartling ..... A47B 87/007 312/223.5
6,164,616 A * 12/2000 Woods ..... A47F 7/0071 248/122.1
6,443,316 B1 * 9/2002 Mao ..... A47L 19/04 211/74

(Continued)

*Primary Examiner* — Patrick D Hawn

(57) ABSTRACT

An integrated display coordination system is provided. The system includes a support structure. The system also includes a base, the base interfaced with the support structure, the support structure having a plurality of display surfaces. The system further includes a plurality of posts, each of the plurality of posts affixed to at least one of the plurality of display surfaces. The system includes display item areas, the display item areas are formed by at least one of the plurality of display surfaces and at least one of the plurality of posts affixed to the plurality of display surfaces. The system is configured wherein the support structure and base, when assembled and connected in a shape of a cube, and wherein the interlocking reusable panels are interconnected with dovetail connections and wherein a bottom of the interlocking reusable panels rest on the base.

6 Claims, 8 Drawing Sheets

(56) References Cited

U.S. PATENT DOCUMENTS 6,715,622 B2 * 4/2004 Keenan ..... A47F 7/0071 211/205
6,883,879 B2 * 4/2005 Latchinian ..... A47F 3/004 312/223.5
6,920,985 B2 * 7/2005 Chandaria ..... A47F 7/00 211/13.1
7,424,958 B1 * 9/2008 Eley ..... A47F 5/0815 211/70.6
D641,570 S * 7/2011 Zieman ..... D3/25
8,020,716 B2 * 9/2011 Vitale ..... A47F 5/04 211/205
D665,197 S * 8/2012 Allameh ..... D6/661.3
8,459,472 B2 * 6/2013 Hofman ..... A47F 5/0815 211/106.01
8,522,986 B2 * 9/2013 Kitchen ..... B25H 3/04 248/220.31
8,967,399 B2 * 3/2015 Hawkins ..... A47F 5/10 211/126.2
9,084,497 B2 * 7/2015 Hawkins ..... A47F 5/114
9,131,789 B1 * 9/2015 Williams ..... A47F 7/02
9,750,342 B1 * 9/2017 McMillan ..... B65H 55/00
9,839,304 B2 * 12/2017 Liao ..... A47F 5/04
10,206,487 B2 * 2/2019 Smith ..... A45D 44/14
10,477,990 B2 * 11/2019 Seba Raffoul ..... A47F 5/108
10,631,711 B2 * 4/2020 Dunn ..... A47L 19/02
10,835,057 B1 * 11/2020 Keogh ..... A47F 5/06
10,869,538 B2 * 12/2020 Smith ..... A45D 44/02
10,869,561 B2 * 12/2020 Arradondo ..... A47F 5/0006
D911,764 S * 3/2021 Tucker ..... D7/354
2002/0113183 A1 * 8/2002 Mattesky ..... A47F 5/0823 248/303
2002/0134743 A1 * 9/2002 Keenan ..... A47F 7/0071 211/85.4
2003/0175663 A1 * 9/2003 Fuchs ..... G09B 19/00 434/94
2004/0134866 A1 * 7/2004 Jerstroem ..... A47L 19/04 211/41.6
2007/0125725 A1 * 6/2007 Kemper ..... A47L 19/04 211/74
2011/0073730 A1 * 3/2011 Kitchen ..... B25H 3/04 248/220.31
2017/0065104 A1 * 3/2017 Metropulos ..... A47J 37/049
2018/0020682 A1 * 1/2018 Bullard ..... A47F 7/0071 426/273
2020/0205586 A1 * 7/2020 Arradondo ..... A47F 5/0006
2020/0337476 A1 * 10/2020 Keogh ..... A47F 5/06

* cited by examiner

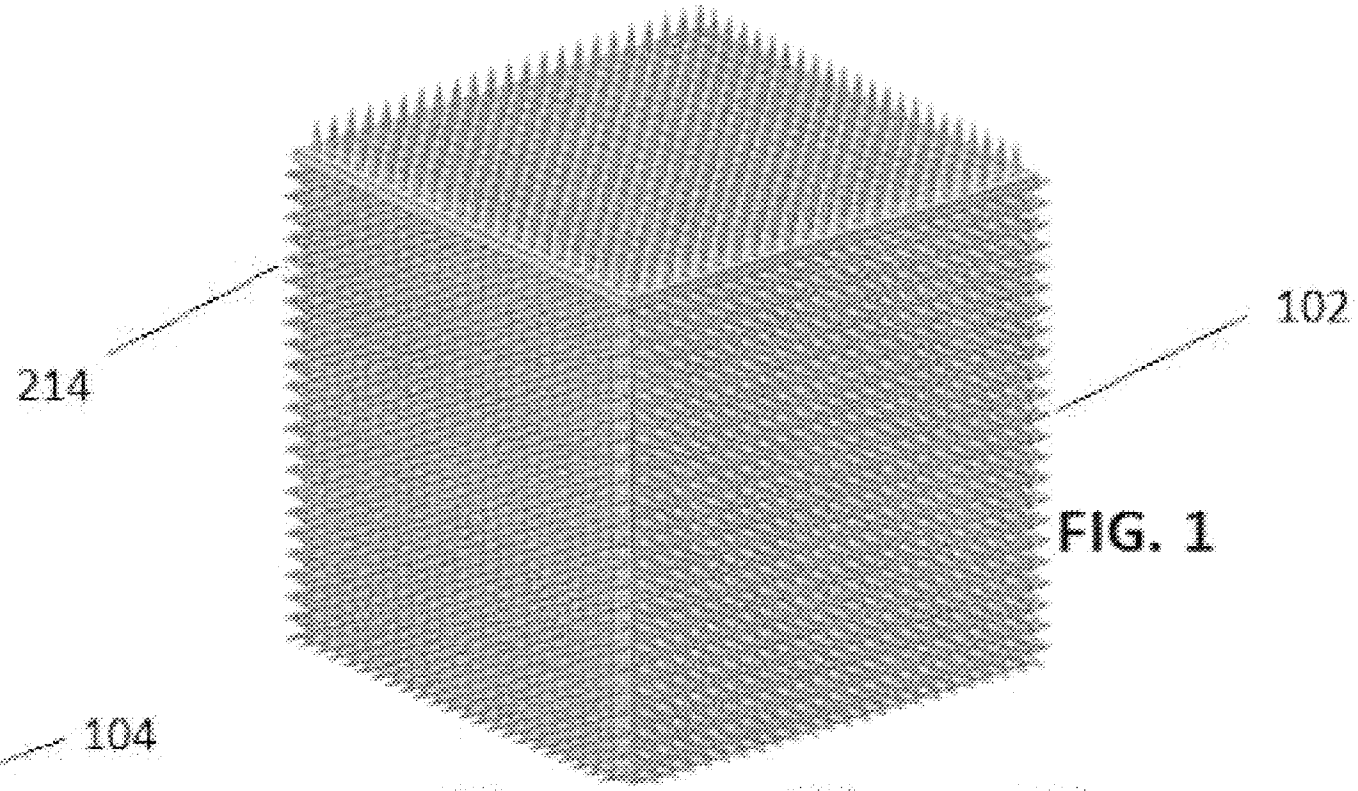
FIG. 1
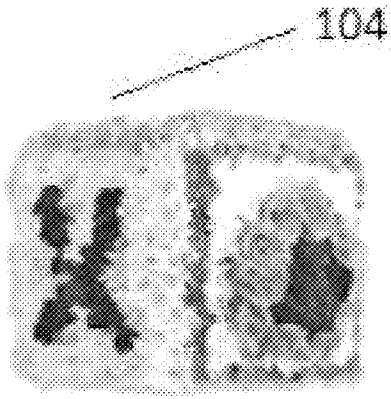
FIG. 1A
FIG. 1B
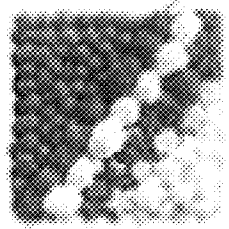
FIG. 1C
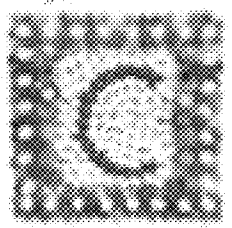
FIG. 1D

500

INTEGRATED DISPLAY COORDINATION SYSTEMS

CROSS-REFERENCE TO RELATED APPLICATIONS

This application claims priority to provisional application 62/760,172 filed on Nov. 13, 2018 and is incorporated herein by reference in its entirety. Further, this application claims priority to non-provisional application Ser. No. 16/679,156 filed on Nov. 9, 2019 and is incorporated herein by reference in its entirety.

FIELD OF THE INVENTION

The present invention relates to display and serve ware systems, and particularly to integrated display and serve-ware coordination systems for creating, displaying, and serving a plurality of items including, but not limited to edible items, inedible items, devices, and/or decorative arrangements.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office files or records, but otherwise reserves all copyrights whatsoever.

BACKGROUND OF THE INVENTION

Previous attempts to create displays and decorative products using edible items such as fruits, vegetables, cheeses, meats, candies, cakes and flowers, for special occasions utilizing reusable, convenient, cost-effective display systems have been unsuccessful. In many instances, a variety of these displays may begin as arts and crafts projects that later serve as centerpieces or objects of art, and therefore the display systems used are typically non-reusable and/or non-sanitary. Reusability, unable to sanitize, and cost-effectiveness have been factors in not having effective and durable options for constructing displays and being able to either eat the accoutrements that may be arranged in a particular form, or to use the arrangement as a sculpture. Further, current systems and processes, due to their non-reusability, make these current systems and processes very expensive and time consuming. The current range of forms for which such products can be assembled are limited, and do not readily allow such items as non-food items as well as food products (e.g., fruits, vegetables, candies, meats, cakes, flowers, and cheeses) to be easily and aesthetically arranged.

The nature of arranging displays requires an appreciation of the time sensitive nature and shelf-life of components included in the displays. As such, many attempts to produce reusable, cost effective and scalable displays have been unsuccessful.

Accordingly, there is an established need for display coordination display systems which solve at least one of the aforementioned problems. Further, there is an established need for integrated display coordination systems, having various forms, that that help a user to create or learn to create, arrange and assemble his or her own visually interesting and/or aesthetically pleasing arrangements which thereafter may be eaten or used as a decoration such as a sculpture.

SUMMARY OF THE INVENTION

According to an aspect of the present invention, an integrated display coordination system is provided. The system includes a support structure. The system also includes a base, the base interfaced with the support structure. The system further includes at least one display surface, the at least one display surface configured to be able to be connected to the base. The system includes a plurality of posts, the plurality of posts configured to be able to be affixed to the at least one display surface. The system also includes display item areas, the display item areas formed by an area of the at least one display surface and/or the plurality of posts affixed to the at least one display surface. The system further includes wherein the display item areas, a plurality of posts, and the at least one display surface are configured to be cleanable, sanitizeable, and reusable before and after utilization of the integrated display coordination system to display items which necessitate cleaning and sanitizing before and after use.

According to another aspect of the present invention, a method for assembling an integrated display coordination system is provided. The method includes selecting one or more support structures having a linear, geometric or non-geometric shape. The method also includes configuring a base to be able to join the base with one or more support structures to create the selected shape by interlocking the base and supports together. The method further includes selecting a fixable design element that is able to be attached to a plurality of posts. The method includes constructing a design element to be able to be arranged to the plurality of posts. The method also includes placing display items to be able to be displayed on at least one display surface and/or to be affixed to the plurality of posts. The method further includes providing a sanitize-able, reusable, and cleanable method to display a completed integrated display coordination system.

According to yet another aspect of the present invention, an integrated display coordination device is provided. The device includes at least one display surface. The system also includes display item areas, the display item areas formed by an area of the at least one display surface and/or a frame. The device further includes wherein the display item areas and the at least one display surface are configured to be cleanable, sanitize-able, and reusable before and after utilization of the integrated display coordination system to display items which necessitate cleaning and sanitizing before and after use.

According to an aspect of the present invention, an integrated display coordination system is provided. The system includes a support structure. The system also includes a base, the base interfaced with the support structure, the support structure having a plurality of display surfaces. The system further includes a plurality of posts, each of the plurality of posts affixed to at least one of the plurality of display surfaces. The system includes display item areas, the display item areas are formed by at least one of the plurality of display surfaces and at least one of the plurality of posts affixed to the plurality of display surfaces. The system is configured wherein the support structure and base, when assembled and connected in a shape of a cube, and wherein the plurality of posts are molded into the plurality of display surfaces forming unitary members, and wherein the each of the plurality of display surfaces and their respective plurality of posts form interlocking reusable panels, and wherein the interlocking reusable panels are interconnected with dovetail connections along edges of the interlocking reusable panels and wherein a bottom of the interlocking reusable panels rest on the base and abuts an inside lip of the base.

In an aspect, the system can include coordination with a plurality of other systems such that design aspects, lighting, musical, and/or movement is synchronized.

An embodiment of the present invention can be a fixture, having a form, fit and function that allows for assembling and displaying objects, including but not limited to foods and plants, having a support surface to which is affixed a plurality of shafts, tines, spikes, skewers, teeth, posts or cylinders, referred generally as post or posts, arrayed in 2-dimensional and/or 3-dimensional geometric shapes, such as polyhedrons (e.g., cube, triangular prism, dodecahedron), or sphere, hemisphere, pyramidal or conical shapes or sections, for securing the edible and inedible objects. The size, shape, diameter, and other measurements and dimensions of the fixture or post may be varied.

In another embodiment, the system can also include posts, the posts can be molded into the framework or surface of a support.

In yet another alternate embodiment, the system can include a surface, the surface of the support can contain holes or receptacles, for the insertion of posts. In this manner the arrangement of posts may offer the user the ability to design an arrangement in the form of a picture, words, slogans and the like. The supports are optionally secured by a base. The support, base and posts may be reusable, recyclable.

In an aspect, the system can reside in a reusable fixture for a linear or three-dimensional arrangement of edible or inedible objects including: one or more support structures having a surface to which is permanently affixed one or more posts that terminate distally in a substantially conical shape to which objects may be attached, including but not limited to food and plants; and a means for joining two or more supports together to construct three-dimensional structures in geometric and non-geometric shapes for the display of food and plants.

In another aspect, the system can also disclose a method for assembling a decorative arrangement comprising the steps of: (i) selecting one or more post support structures having a linear, geometric or non-geometric shape from a plurality of post support structures, (ii) selecting a base for the selected shape, (iii) joining a base with one or more support structures to create the selected shape by interlocking the base and supports together, (iv) selecting a fixable design element that is attachable to a post, (v) affixing a design element, in an original way or assisted by suggested creative designs, (vi) displaying a completed decorative arrangement.

In yet another aspect, the system can include a post, the post may or may be formed from an illumination device such as by way of example and not limitation, a light emitting diode (LED), which may be detachable, replaceable or permanently affixed to a post, or alternatively may form all or a portion of a post.

In an embodiment, the system can include supports, the supports may be joined by one or more interlocking joints such as, but not limited to, tongue and groove joints, mortise and tenon joints, dowel joints, finger joints, or alternatively by one or more hinges, such as barrel or slip hinges or alternatively, or by way of a screw top-and-cap or twist on-off, type of interlocking mechanisms, magnetic attraction, static friction, electromagnetic attraction, Velcro, and/or surface adhesion.

In another embodiment, the system can also include a fixture, the fixture may be assembled into a variety of post structures, including but not limited to a variety of geometric or non-geometric shapes or patterns, or into familiar objects including but not limited to animals, or themed-shapes for holidays and parties.

In yet another embodiment of the invention, the system can include a fixture, the fixture may be displayed on a substantially flat surface, or may otherwise be suspended or hung when properly secured in the first instance at two or more places on the fixture, and then safely and securely attached at the other end in a manner in that allows a fully designed to be safely displayed.

In an aspect, the system can include a fixture, the fixture may be manufactured from a food-safe material well known in the art, which may include plastics, metals, glass, paper, textiles, composites, wood, leather, and other materials and may also be dishwasher and/or microwave safe.

In another aspect, the system can also include support, posts and base material which may be approved by the U.S. Food and Drug Administration (USFDA), or other relevant authorities as necessary. An embodiment can include a method of manufacturing to produce the support and posts, by injection molding, representing a type of integral, or formed-together unitary product. Additionally, other manufacturing methods but not limited to cast molding, extrusion, 3-D printing, and/or CNC manufacturing methods can be used to form any and/or all elements of the system.

In yet another aspect, the system can include posts and/or spikes which are bendable and/or flexible. The bendable and/or flexible posts and/or spikes can be configured to be bent into curved and/or non-linear shapes.

In an embodiment, the system can include a plurality of telescoping posts and/or spikes. The plurality of posts and/or spikes configurable to allow a variable distance of an end of a post and/or spike from a surface of a base.

In another embodiment, the system can also include magnetic tips, the magnetic tips configurable on ends of posts and/or spikes. The magnetic tips can be configured to attach to ferromagnetic devices and/or items. Further, the system can include Velcro and/or adhesive materials.

In yet another embodiment, the system can also include posts and/or spikes with fluid passageways inherent in the posts and/or spikes such that fluids can flow through within cavities of the posts and/or spikes.

In an aspect, the system can include electrical power sources, the electrical power sources configured to provide power to move and/or to illuminate components of the system.

In another aspect, the system can include cordless lighting sources, such as but not limited to batteries and/or solar panels.

In yet another aspect, the system can include a computer and/or a processor. The computer and/or processor configured to provide a control mechanism for the system to coordinate light, power, movement, and/or coordination with a plurality of systems.

In an embodiment, the system can include a mobile application, the mobile application configured to actuate and/or control components of the system, such as but not limited to lighting, movement, and/or coordination with a plurality of systems.

In another embodiment, the system can also include mechanisms for moving fluid. The mechanisms can include pumps and/or fans to move fluids including but not limited to water and/or gases within and/or from within and/or external to the system.

In yet another embodiment, the system can also include reusable components, the components can be structured to be a unitary piece or separate attachable components.

In an aspect, the system can include a plurality of posts and/or spikes oriented in a plurality of angles, such as but not limited to 5, 45, 90, 180, 270, 360 degrees and/or any degree or fraction of degree in between, from a base.

In another aspect, the system can also include a plurality of coordinated display systems, the plurality of display systems structured to operate in concert.

In yet another aspect, the system can include motors and/or engines, the motors and/or engines arranged to provide a means of movement of a plurality of components of the system.

In an embodiment, the system can include acoustic components, the acoustic components configured to provide music and/or sound effects for the system.

In another embodiment, the system can also include biodegradable components.

In yet another embodiment, the system can include a plurality of spikes and/or posts, the plurality of spikes and/or posts structured to rotate, move reciprocally, and/or move laterally in x, y, and/or z axes.

In an aspect, the system can include a plurality of spikes and/or posts, the plurality of spikes and/or posts arranged in a coordinated array of angles from each other.

In another aspect, the system can also include pyrotechnic components.

In yet another aspect, the system can include coating materials, the coating materials including but not limited to non-wetting surface materials, non-stick materials, anti-corrosion materials, water absorbing materials, and/or non-water absorbing materials.

In an embodiment, the system may or may not include a support structure.

In another embodiment, the system may or may not include a base.

In yet another embodiment, the system may or may not include a plurality of posts.

In an aspect, the system may or may not include a display item area with a plurality of posts.

In another aspect, a method for assembling an integrated display coordination system may or may not include selecting one or more support structures.

In yet another aspect, a method for assembling an integrated display coordination system may or may not include a base.

In an embodiment, the system can include sanitize-able components so as to allow sterilizing the system before and after use.

In another embodiment, the system can also include attachment mechanisms, the mechanisms arranged to allow for attaching components of the system allowing for effective cleaning and sanitizing.

In yet another embodiment, the system can include reusable components, the reusable components structured to allow repeated use without material degradation of the components.

In an aspect, the system can include reusable components which are formed integrally, separately, and/or in a unitary piece.

In another aspect, the system can include sanitize-able components, the sanitize-able components designed to allow for cleaning in a dishwasher, cleaning in an autoclave, and/or a sterilizer.

These and other features and advantages will become apparent from the following detailed description of illustrative embodiments thereof, which is to be read in connection with the accompanying drawings.

BRIEF DESCRIPTION OF THE DRAWINGS

The features and advantages of the present invention will be better understood when the Detailed Description of the Preferred Embodiments given below is considered in conjunction with the figures provided.

FIGS. 1 and 1A is a perspective view of a post support structure or fixture in accordance with an embodiment of the present invention;

FIG. 1B is a perspective view of a post support structure or fixture having placed thereon decorative objects in accordance with an embodiment of the present invention;

FIG. 1C is a top view of a fixture having placed thereon decorative objects in accordance with an embodiment of the present invention;

FIG. 1D is a top view of a fixture having placed thereon decorative objects in accordance with an embodiment of the present invention;

DETAILED DESCRIPTION

Figures 2A, 2B, 2C:
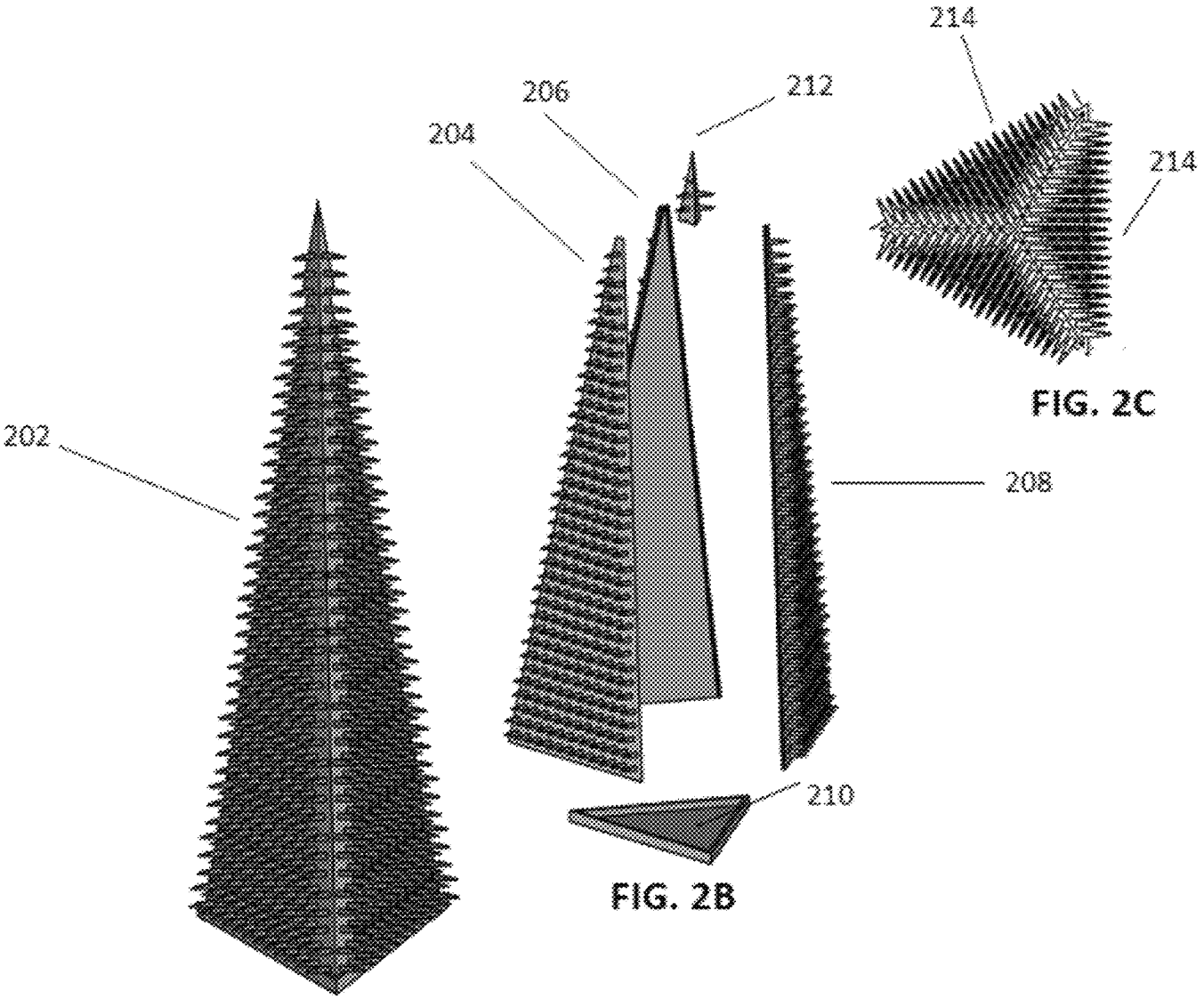
FIG. 2A is a perspective view of a fixture in accordance with an embodiment of the present invention.
FIG. 2B is an exploded view of a fixture 2A in accordance with an embodiment of the present invention.
FIG. 2C is a top view of fixture 2A in accordance with an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

In one embodiment of the invention, two or more post support structures having a means for connecting said supports together creates linear patterns or three-dimensional structures in a variety of geometric and non-geometric shapes for the display of organic and inorganic design elements. As shown in FIG. 1*a*, a non-limiting embodiment of a fully assembled undecorated post support structure or fixture 102 is connected via support structure and base (not shown) in the shape of a cube. Other post support structure shapes may be used, as by way of example and not limitation: 3-dimensional geometric shapes, such as the full set of polyhedrons (e.g., cube, triangular prism, dodecahedron), or conic sections, (e.g. a cone, parabola, spheres, hemispheres).

In another non-limiting embodiment of the invention, one or more of the supports and/or one or more posts 214 are permanently affixed to the surface of fixture 102, and may be designated by one or more colors, numbers, letters or other methods of coding such that when the support and/or posts are assembled, the final design is similar to a suggested design and assembly pattern or instruction.

In another embodiment, the one or more posts 214, or sections of posts, may be removable or made permanent via molding them into the surface of the fixture 102. By way of example and not limitation, removal of one or more posts or sections of posts may permit the addition of other design elements or objects that might fill a void left by the removal of one or more posts, or may permit the user to add posts of differing shape, size or dimension, or add a section to the support that is devoid of one or more posts. Alternatively, one or more posts 214 may be made longer. By way of example and not limitation, a post varied in length or diameter may be affixed to a pre-existing post to increase the size, length or dimension of an original post. Alternatively, a post or section of posts may be removed and in its stead, a blank portion of the support may be inserted, so as to create one or more places where posts are absent from the structure. Changing or alternating posts or creating blank spaces, may be desirable in achieving a certain shape or design.

Turning to fixture 102 as decorated in FIG. 1B through FIG. 1D, inclusive, where a variety of possible design elements is employed. FIG. 1C through FIG. 1D illustrate a top down view of several non-limiting embodiments of the fixture 100 demonstrating the use of flowers 104, fruit 106, vegetables 108 and candy 110 as design elements. In yet another non-limiting embodiment, a support, base and/or posts may be pre-assembled in whole or in part in predetermined shapes and designs. By way of example, and not limitation, a user who desires to display a food arrangement for a child's party may select a partially assembled mermaid shape, so that the creation of the final display, which may include selecting an overall design pattern, determining edible or non-edible design elements such as food, plants, lights, may be completed by an adult, or child, or both as part of a shared creative experience.

FIG. 2A illustrates one non-limiting embodiment of a fully assembled undecorated fixture 202 in the shape of a pyramid. FIG. 2B is an exploded view of one non-limiting embodiment of a fixture 202, and having three support structures, 204, 206 and 208, respectively, a base 210 and a locking tip 212.

FIG. 2C is a top down view of one non-limiting embodiment of a fully assembled, undecorated fixture 202, showing a plurality of posts 214 jutting out from each support 204, 206, 208 as illustrated in FIG. 2B. In one non-limiting embodiment of the invention, one or more posts 214 are permanently affixed to a support 204. In another non-limiting embodiment of the invention, one or more posts 214 are removable or extendable (not shown). In another non-limiting embodiment, the shape and dimension of a post or sections of post may be altered by the addition of another lengthening and/or widening post (not shown) the fits over atop an existing post or group of posts.

Figure 3B:
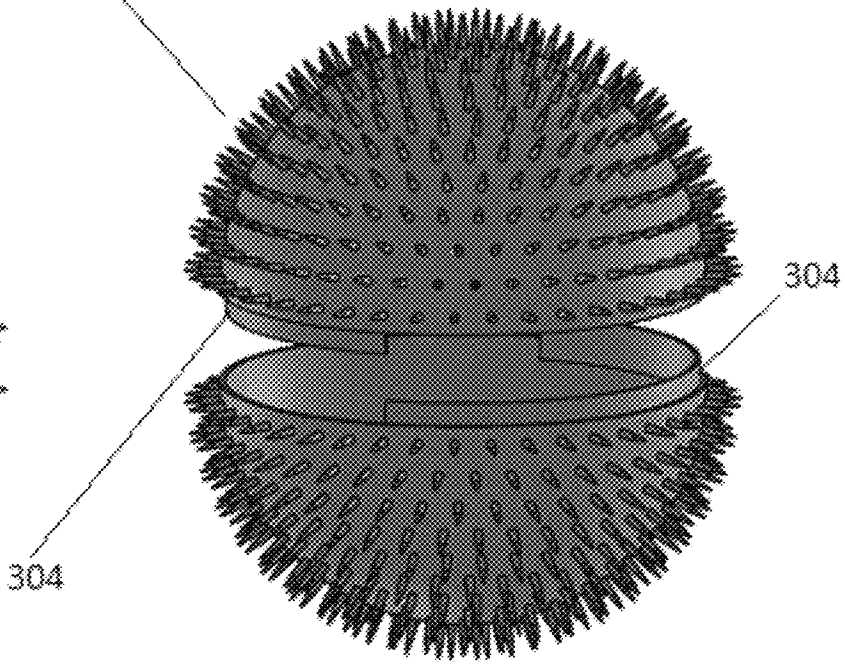
FIG. 3B is an exploded view of the fixture in 3A, in accordance with one non-limiting embodiment of the present invention.
Figure 3A:
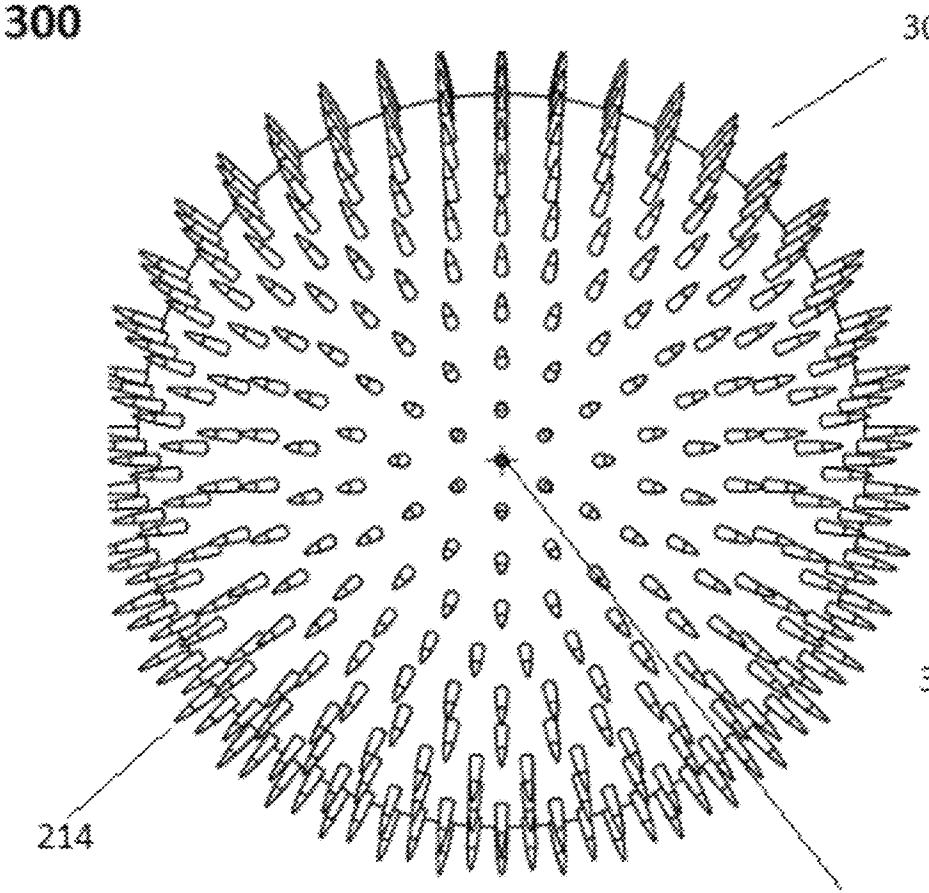
FIG. 3A is a top view of a fixture in accordance with an embodiment of the present invention.

FIG. 3A is a top-down view of one non-limiting embodiment of a fixture 302. FIG. 3B is an exploded view of fixture 302. A non-limiting embodiment of a twist on-off interlocking mechanism 304 is shown. In another non-limiting embodiment, a fixture may be suspended by securing and threading a length of material (e.g., cord, hanger) (not shown) through a thru-hole 306 and securing the other end of the material at the other end to a support (e.g., hook) (not shown).

Figure 4A:
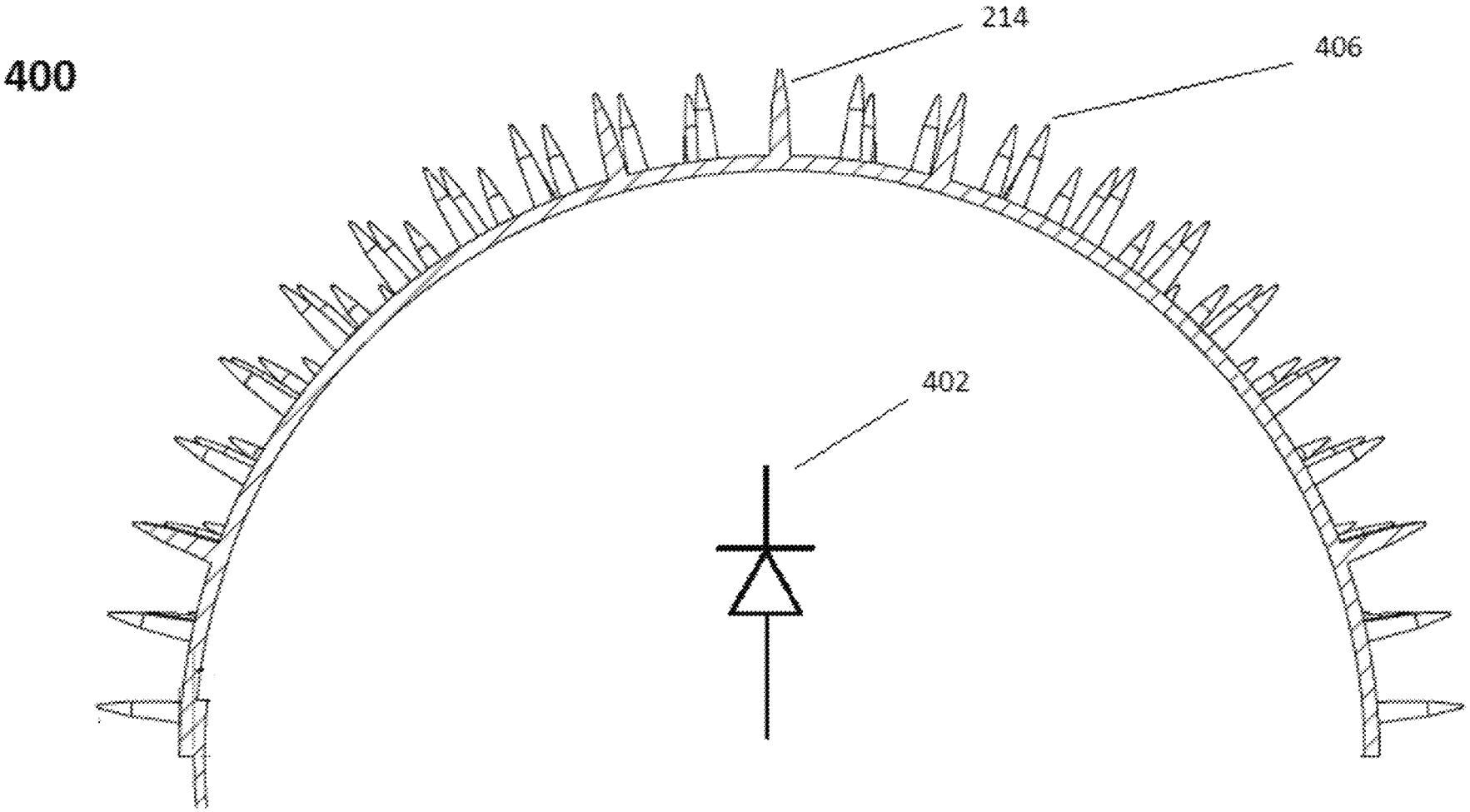
FIG. 4A is a cross-sectional view of the fixture in 3A in accordance with an embodiment of the present invention.

FIG. 4A shows a cross-section of FIG. 3A with an optional light emitting diode (LED) 402 within the fixture for illuminating one or more of the posts 214 or post tips 406.

Figure 5:
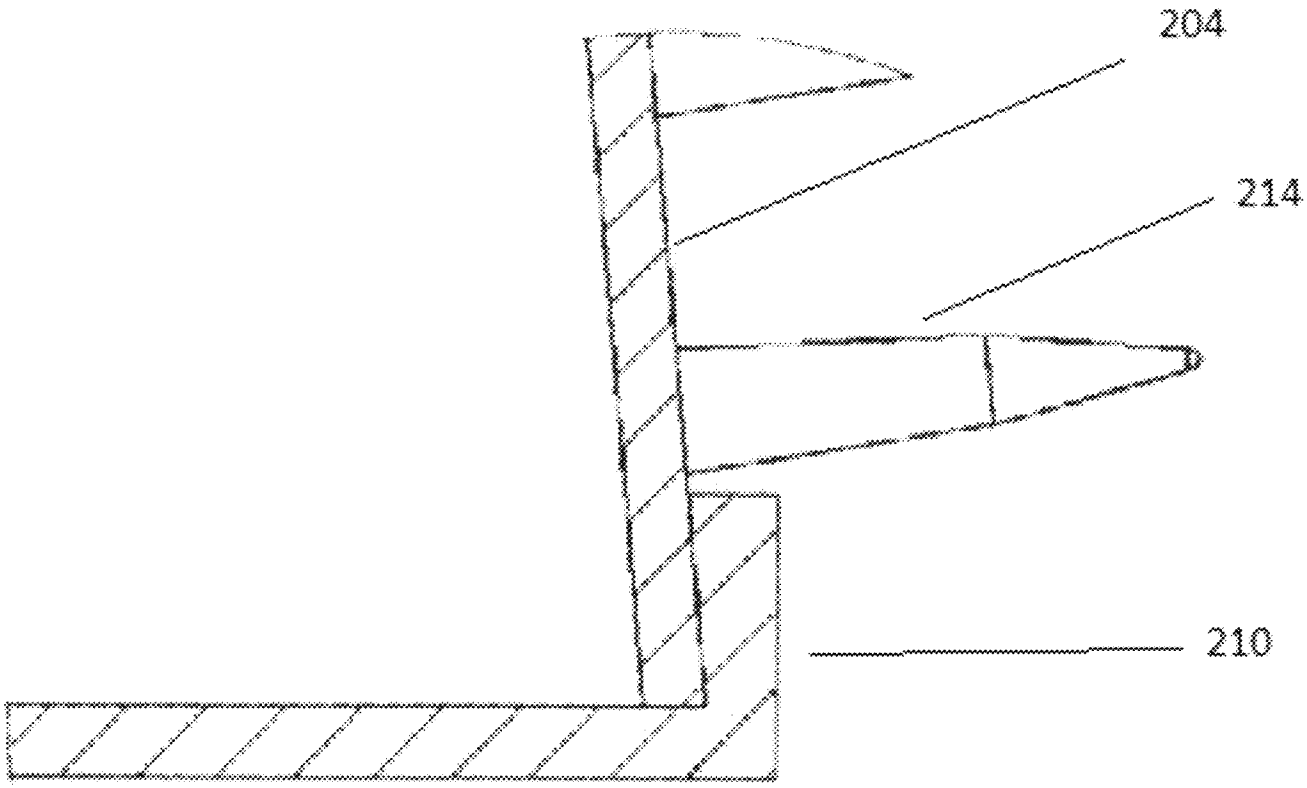
FIG. 5 is a cross-sectional view of a fixture in accordance with one non-limiting embodiment of the present invention.

FIG. 5 shows a partial section of FIG. 2A, showing a means for joining a support 204 with a base 210.

The fixture 100 may be constructed through a variety of processes and techniques, such as injection molding, thermoforming, 3D printing, additive manufacturing, metal forming, as well as utilizing adhesives, mating parts or other means of joining or molding materials. Such processes and techniques are well-known to those skilled in the art of manufacturing and assembling two-dimensional and three-dimensional shaped fixtures constructed from metals, plastics and recyclable materials. In a preferred embodiment the post support structure 102 and posts 214 are integrally molded into the support structure and protrude so as to enable the use of the chosen decorations (fruits, vegetables, etc.). However, as indicated above, in an alternate embodiment (not shown), the support structure 102 contains holes or receptacles, for the insertion of posts 214. In this manner the arrangement of posts may offer the user the ability to design an arrangement in the form of a picture, words, slogans and the like.

As can be appreciated, a plurality of supports may be connected together in varying combinations to create a variety of support shapes. Further, a plurality of design elements, (e.g., organic elements such as fruits, vegetables, flowers, and inorganic elements such as lights, LEDs, messages, or objects having a suggestive or themed shape) may be attached to one or more posts to achieve a decorative arrangement.

In another embodiment, a post may exist as or may be formed from an illumination device, such as by way of example and not limitation, the distal end of a post may contain one or more light emitting diodes (LEDs), which may be detachable, replaceable or permanently affixed to a post. Alternatively, a post may contain or have a detachable, replacement or permanently affixed bundle of fiber optic strands through which light may be transmitted and displayed. The LED may emit one or more colors, may be permanently on or off, or dim/brighten or flash on/off, at varying speeds. The one or more LEDs may be controlled by a switch, or alternatively by a wireless technology, such as BLUETOOTH™ (Bluetooth is a registered trademark of Bluetooth SIG, Inc.) through an independent controller or smart-tablet or smartphone (not shown).

The present invention can also include a method for assembling decorative arrangements employing the steps of: (i) selecting one or more support structures for a linear, geometric or non-geometric shape from a plurality of support structure designs, (ii) selecting a base for the selected shape, (iii) joining a base with one or more support structures to create the selected shape by interlocking the base and supports into a rigid framework, (iv) selecting a fixable design element that is attachable to a post 214, (v) affixing a design element, in one of an original way or assisted by suggested creative designs, (vi) displaying a completed decorative arrangement.

Figure 6:
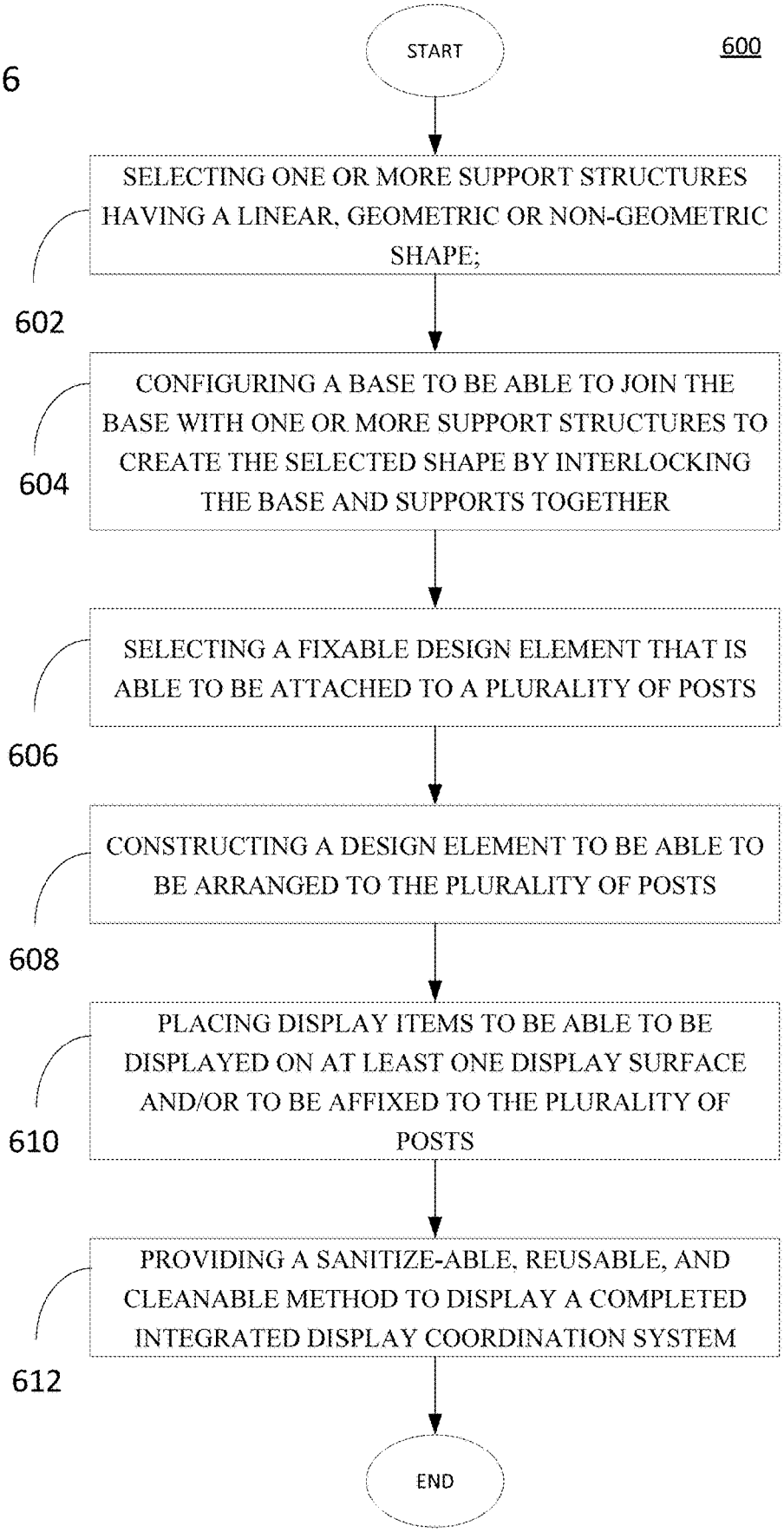
FIG. 6 is a flowchart displaying a method of an embodiment of the present invention.

As best seen in FIG. 6, the system can include a method for utilizing an integrated display coordination system 600. The method includes selecting one or more support structures having a linear, geometric or non-geometric shape 602. The method also includes configuring a base to be able to join the base with one or more support structures to create the selected shape by interlocking the base and supports together 604. The method further includes selecting a fixable design element that is able to be attached to a plurality of posts 606. The method includes constructing a design element to be able to be arranged to the plurality of posts 608. The method also includes placing display items to be able to be displayed on at least one display surface and/or to be affixed to the plurality of posts 610. The method further includes providing a sanitize-able, reusable, and cleanable method to display a completed integrated display coordination system 612.

Figure 7:
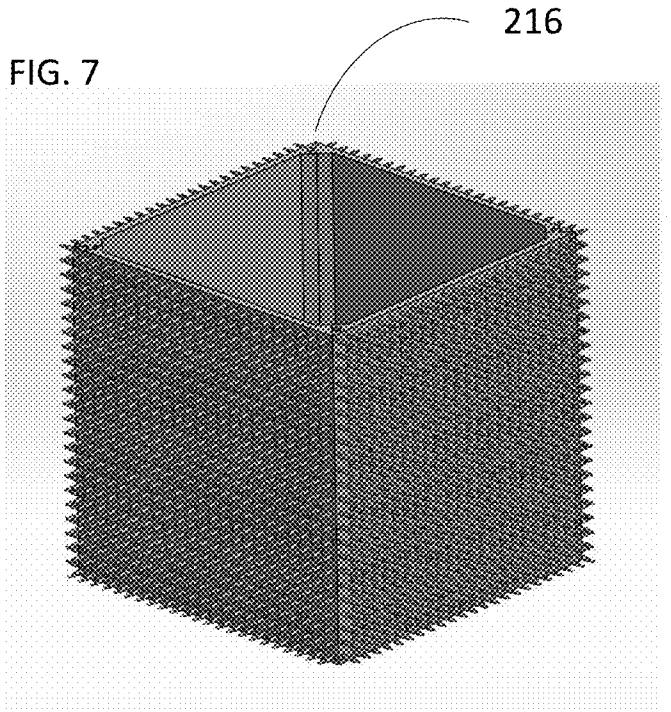
FIG. 7 depicts a perspective view of an embodiment of the present invention.
Figure 8:
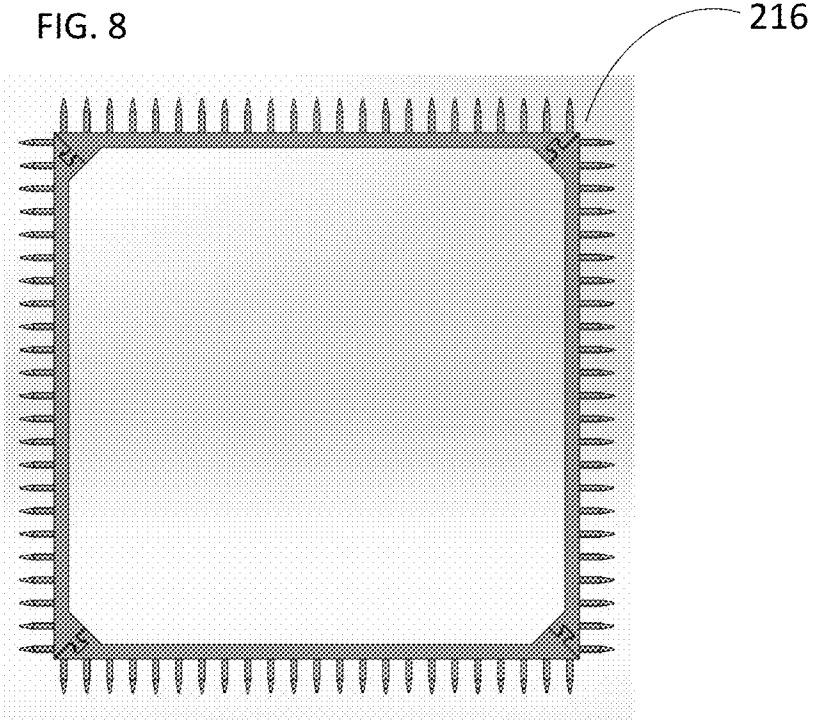
FIG. 8 depicts a top view of an embodiment of the present invention.

As best seen in FIGS. 7 and 8 interlocking panels are interconnected with dovetail connections 216.

In embodiments not shown, the system can include self-powered components, the components configured such that elements of the system can move and animate in synchronization with music, lights, and/or other systems. Embodiments of the system can be scalable such that coordinated display systems can operate on top of, but not limited to, a standard kitchen table, a chair, a sound stage for an outdoor concert, a baseball field, a football field, and/or a sports arena, the system arranged to be as large as the surface area that the system exists. The system can be designed to be compact and/or large.

In other embodiments not shown, the system can include lighting components, the lighting components designed to change in illumination, brightness, color, and/or blinking with respect to time. The system can be used in theatrical performances and/or musical performances. Further, the system can be used in large displays such as on the field during a half-time of a football game or before a baseball game.

In embodiments not shown, the system can include coordinated display systems structured to display frozen foods and/or temperature sensitive items. The system including refrigeration systems and/or heating systems designed to maintain display items at predetermined temperatures. Items such as ice cream and/or hot foods can be displayed on the system.

In some embodiments, the method or methods described above may be executed or carried out by a computing system including a tangible computer-readable storage medium, also described herein as a storage machine, that holds machine-readable instructions executable by a logic machine (i.e. a processor or programmable control device) to provide, implement, perform, and/or enact the above described methods, processes and/or tasks. When such methods and processes are implemented, the state of the storage machine may be changed to hold different data. For example, the storage machine may include memory devices such as various hard disk drives, CD, flash drives, cloud storage, or DVD devices. The logic machine may execute machine-readable instructions via one or more physical information and/or logic processing devices. For example, the logic machine may be configured to execute instructions to perform tasks for a computer program. The logic machine may include one or more processors to execute the machine-readable instructions. The computing system may include a display subsystem to display a graphical user interface (GUI) or any visual element of the methods or processes described above. For example, the display subsystem, storage machine, and logic machine may be integrated such that the above method may be executed while visual elements of the disclosed system and/or method are displayed on a display screen for user consumption. The computing system may include an input subsystem that receives user input. The input subsystem may be configured to connect to and receive input from devices such as a mouse, keyboard or gaming controller. For example, a user input may indicate a request that certain task is to be executed by the computing system, such as requesting the computing system to display any of the above described information, or requesting that the user input updates or modifies existing stored information for processing. A communication subsystem may allow the methods described above to be executed or provided over a computer network. For example, the communication subsystem may be configured to enable the computing system to communicate with a plurality of personal computing devices. The communication subsystem may include wired and/or wireless communication devices to facilitate networked communication. The described methods or processes may be executed, provided, or implemented for a user or one or more computing devices via a computer-program product such as via an application programming interface (API).

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

The present invention has been described with reference to the preferred embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of manufacture, shape, size, or materials which are not specified within the detailed written description or illustrations contained herein are considered within the scope of the present invention.

What is claimed:

1. An integrated display coordination system comprising of:

a support structure;

a base, the base interfaced with the support structure, the support structure having a plurality of display surfaces;

a plurality of posts, each of the plurality of posts affixed to at least one of the plurality of display surfaces;

display item areas, the display item areas are formed by at least one of the plurality of display surfaces and at least one of the plurality of posts affixed to the plurality of display surfaces; and wherein the support structure and base are assembled and connected into a shape of a cube, and wherein the plurality of posts are molded into the plurality of display surfaces forming unitary members, and wherein the each of the plurality of display surfaces and their respective plurality of posts form interlocking reusable panels, and wherein the interlocking reusable panels are interconnected with dovetail connections along edges of the interlocking reusable panels and wherein a bottom of the interlocking reusable panels rest on the base and abut an inside lip of the base.

2. The system as recited in claim 1 wherein at least one of the plurality of posts are bendable and/or flexible and can be configured to be bent into curved and/or non-linear shapes.

3. The system as recited in claim 1 wherein at least one of the plurality of posts includes a variation in length or diameter.

4. The system as recited in claim 1 wherein at least one of the posts comprises magnetic tips.

5. The system as recited in claim 1 wherein at least one of the posts comprises a lighting device.

6. The system as recited in claim 1 wherein at least the interlocking reusable panels are washable in a dishwasher.

* * * * *